United States Patent [19]

Blain

[11] Patent Number: 4,800,990

[45] Date of Patent: Jan. 31, 1989

[54] THREE SPEED VALVE CONTROL FOR HIGH PERFORMANCE HYDRAULIC ELEVATOR

[76] Inventor: Roy W. Blain, Böllinger Höfe, D-7100 Heilbronn, Fed. Rep. of Germany

[21] Appl. No.: 48,101

[22] Filed: May 7, 1987

[51] Int. Cl.[4] ..... B66B 1/04

[52] U.S. Cl. ..... 187/17; 187/28; 187/111; 91/421; 91/452

[58] Field of Search ..... 187/17, 28, 29.2, 68, 187/111, 116; 91/421, 443, 452

[56] References Cited

U.S. PATENT DOCUMENTS 2,319,125 5/1943 Grote ..... 187/111

FOREIGN PATENT DOCUMENTS 1378345 12/1974 United Kingdom .

*Primary Examiner*—Joseph J. Rolla

*Assistant Examiner*—Stephen B. Parker

*Attorney, Agent, or Firm*—Eugene Chovanes

[57] ABSTRACT

A hydraulic elevator up direction control system is provided including a circulating valve connected between the supply and the return of a source that normally supplies pressure to the cylinder of an elevator controlled by a two position switchable setting valve that influences the pilot fluid pressure in the operating chamber of the circulating valve to control the size of opening of the circulating valve and thereby the volume of fluid passing through the circulating valve affecting inversely the volume of fluid passing through a check valve, to provide two distinctive intermediate up speeds of travel in addition to the nominal full speed of travel facilitating a fast, smooth and accurate ride of the elevator car as it approaches a stopping point relative to an upper floor of a building. A three speed down direction control system presents no problems of significance and is not dealt with.

5 Claims, 3 Drawing Sheets

THREE SPEED VALVE CONTROL FOR HIGH PERFORMANCE HYDRAULIC ELEVATOR

STATEMENT OF THE INVENTION

This invention relates to a drive control system for a hydraulic elevator.

REFERENCE TO COMPANION PATENT

This application is a companion application to my prior U.S. Pat. No. 4,637,495 granted Jan. 20, 1987 entitled "Pressure/Viscosity Compensated Up Travel for a Hydraulic Elevator."

BRIEF DESCRIPTION OF THE PRIOR ART

The present invention is supplementary to the invention of my prior British Patent No. 1.378.345 of Dec. 27, 1974 entitled "Drive Control Systems for an Hydraulic Elevator."

Hydraulic elevators should approach their scheduled stopping positions gently and accurately. To establish alignment of the bottom of an elevator car and a floor when the stopping point is approached from below at a creeping speed of travel during the final stage of approach, different control systems have been developed which are, however, dependent in relatively large degrees on load and viscosity, particularly in the case of faster traveling elevators where ideal characteristics in respect to travel time and passenger comfort cannot easily be achieved with the existing system of two speeds of up travel consisting of a full speed and a creeping speed, because increases in loading on the elevator car or in the temperature of fluid often result in a shorter slowdown distance of the car and consequently to a longer creeping distance into the floor and therefore a longer floor-to-floor traveling time. This longer traveling time can be reduced by increasing the up creep of the car. However, such increase in creep speed results in less stopping accuracy at floor level.

A major improvement in performance of the elevator operation can be achieved by employing a system with three speeds of up travel.

One method of achieving a third or intermediate up speed is to employ a second pump in the driving system. This, however, together with the additional driving motor required, the obligatory larger tank and the longer installation time, becomes restrictively expensive. A further disadvantage of the second pump method is that no adjustment of the flow output of the pump is possible once installed. Suddenness of starting and stopping of the elevator car without the addition of further control elements such as valving is not possible.

An alternative method to achieve a third or intermediate up travel speed is to sense the position of the check valve electronically and, by application of a typical servo system, to control through means of hydraulic proportional valves the position of the circulating valve and thereby the flow of fluid passing through the check valve to the elevator cylinder.

This latter method would be relatively expensive, more likely to malfunction due to over-sensitivity of the electronic equipment, for example at lower temperatures, and would require more highly qualified personnel for maintenance than are normally available in the elevator servicing branch.

SUMMARY OF THE INVENTION

An object of the invention is to devise a three speed control of a hydraulic elevator by applying a two-position switching device to the setting valve control of the up creeping speed within the control valve in such a way that an additional creep or intermediate elevator car speed becomes available and effective in decreasing the up traveling time and improving comfort and stopping accuracy of the elevator.

Another object of the invention is to make available an intermediate up traveling speed, useful during installation, servicing or inspection of the elevator.

Another object of the invention is to achieve an intermediate up travel speed which remains practically constant independent of load changes of the car or temperature variations of the oil within the hydraulic system.

The vertical axis of the diagram represents the distance between floors, the horizontal axis represents the speed of travel. The vertical stripes illustrate the duration of electrical energizing of the motor and of the solenoids 29, 28 and 236 for up travel, and the effect of their being de-energized on the up speeds of the car.

DETAILED DESCRIPTION

Figure 1:
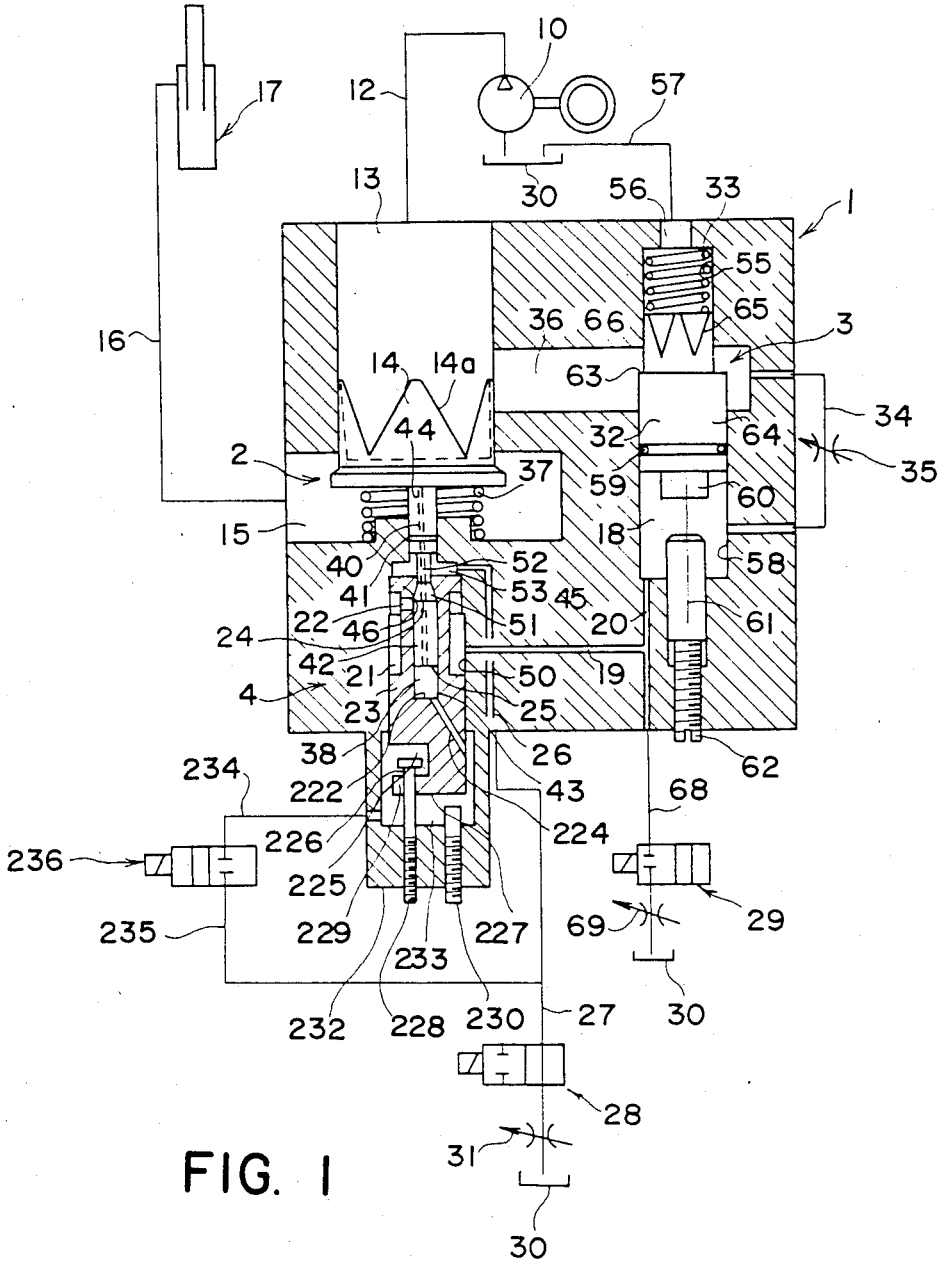
FIG. 1 is a schematic hydraulic circuit diagram illustrating an elevator up control system including a circulating valve in combination with a check valve equipped with a two-position switchable setting valve.
Figure 2:
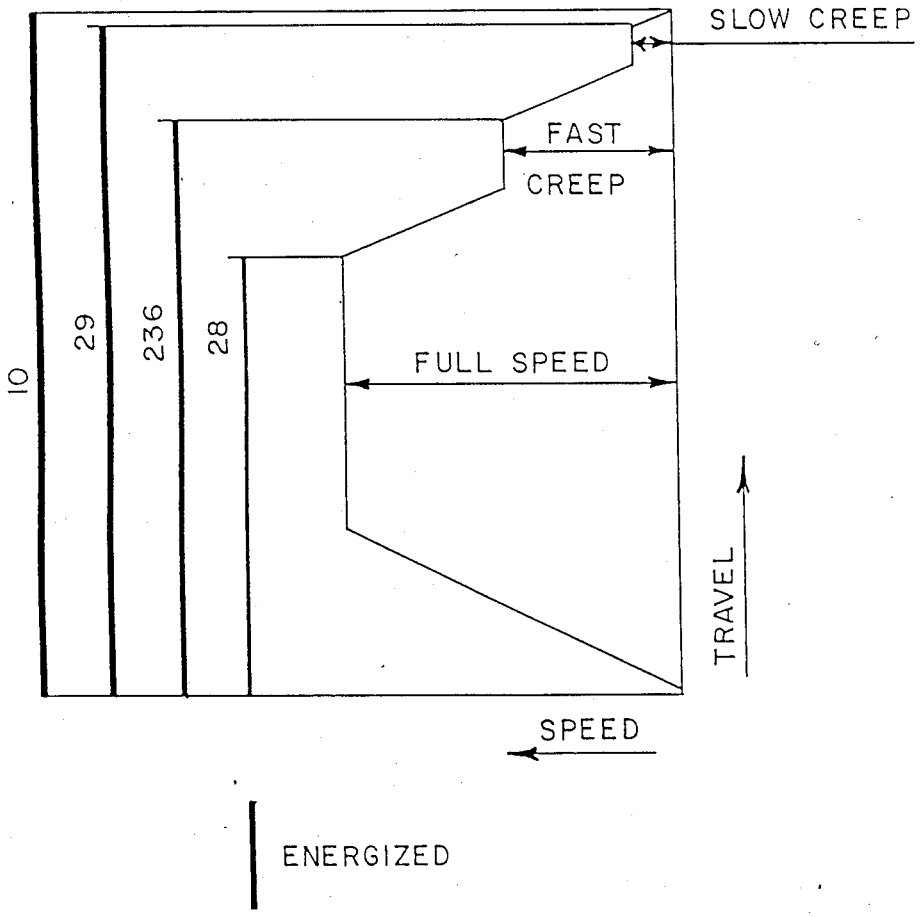
FIG. 2 is an electrical sequence diagram showing a typical energizing sequence of the hydraulic system pump drive motor and solenoid valves, pilot controlling the direction and volume of the main flow of fluid to produce three selectable speeds of up travel of a hydraulic elevator.
Figure 3:
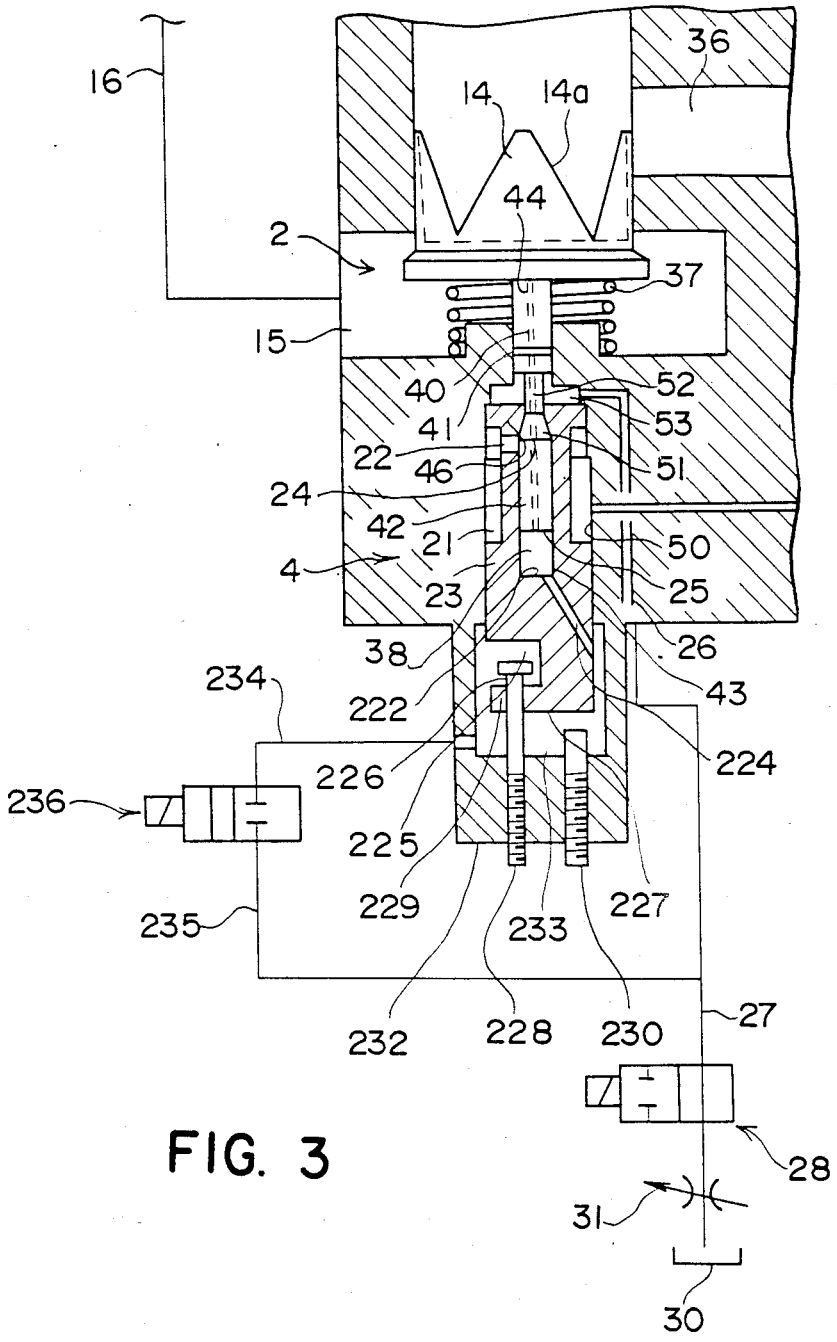
FIG. 3. is an enlarged fragmentary view of FIG. 1 showing the setting valve.

Referring first more particularly to FIG. 1, the illustrated embodiment comprises a valve body 1, containing bores in which are situated a check valve 2, a circulating or by-pass valve 3 and setting valve 4. The valve 4 is described as a "setting valve" throughout the description and claims, for easier distinction from the other valves, although it performs several functions within the scope of the regulating creeping speed of travel of the lift, which functions will become apparent from the drawing and the following description. A pump 10 in communication with a pump chamber 13 via conduit 12 serves as a source of pressure fluid. Conduit 16 leads to an elevator cylinder 17 from a chamber 15 formed in the valve body 1.

The check valve 2 includes a crown-shaped valve element 14 slidably guided in the control block pump chamber 13 which valve element includes V-shaped restriction slots **14*a*. The valve element 14 is biased upwardly in a direction toward the pump chamber 13 by check valve spring 37 so that the check valve 2 automatically closes upon reduction of the pressure in the control block pump chamber 13, thereby to prevent return of hydraulic oil from the elevator cylinder 17 to the chamber 13**.

The setting valve 4 is arranged co-axially relative to the check valve 2. To this end, the valve element 14 has a cylindrical extension 40 which is slidingly guided and sealed by means of an O-ring 41 in a corresponding bore contained in the valve body 1. A setting element 25 of the setting valve 4 is connected in interlocking fashion to the valve element 14 of the check valve 2 by means of the extension 40. The setting element 25 has cylindrical portion 42 which is arranged in a sealed but displaceable and rotatable manner in a central bore 43 of a setting valve sleeve 23. A plunger compartment 38 is connected by a central bore 44 with the pump chamber 13, thereby producing a pressure equalization in order to secure a constant creeping of travel of the lift independently of the operating pressure. The setting valve sleeve 23 is equipped with an external sealing diameter 45 slidable within the sealing bore 46 of the setting valve 4. The sleeve 23 has a lower shank portion which is guided in sealed fashion in a bore 50 of the setting valve 4. An appropriate recess forms an annular gap 21. In a front area of sleeve 23, a setting valve bore 22 leads from said front area to the central bore 43 wherein the setting element 25 is displaceably located. At a correct setting, a control edge 24 of the setting element 25 is situated in the area of the setting valve bore 22. A conical control surface 51 sloping with small taper extends in a direction towards the sealing element 41 from the control edge 24. The surface 51 is formed with an angle of inclination of approximately 2° and is divided by as sharp an edge 24 as possible from the cylindrical part 42 of the setting element 25. The control surface 51 is continued at a top portion thereof by a cylindrical shank portion 52. Between the shank portion 52 and the sealing bore 46 an annular space 53 is formed. A setting valve overflow passage 26 is connected with an inlet of an electromagnetic valve 28 via a setting valve outflow conduit 27. The electromagnetic valve 28 is a two-position valve which is arranged to be switched to the illustrated conducting position in which throughflow occurs when the valve 28 is de-energized. An outlet of the valve 28 is connected with an oil collection vessel 30 via a setting valve discharge restrictor 31.

A circulating valve passage 36 branches off from the pump chamber 13, above the valve element 14. An outlet bore 55 leads upwards from duct 36. The bore 55 is followed by a smaller diameter outlet 56 from which a circulating valve outlet conduit 57 leads to the oil collection vessel or sump 30. Coaxially with the outlet bore 55 and situated on the other side relative to the circulating valve passage 36, is located a valve bore 58 which has a slightly greater diameter than the outlet bore 55. A cylindrical circulating valve element 32 is guided in an axially displaceable manner in the valve bore 58. The element 32 is sealed by an O-ring 59 and has an extension 60 which, for limitation of the stroke of the element is arranged to strike against an abutment member 61 which is mounted for axial adjustment in the control block 1 by means of a screw-threaded extension 62. Circulating or by-pass valve chamber 18 is formed below the circulating valve element 32. The small difference in diameter between the bores 55 and 58 results in the formation of a small annular surface 63 between a cylindrical part 64 of the valve element 32 sliding in the cylindrical valve bore 58, and guiding extension 65 having V-shaped restrictor slots 66. The circulating valve element 32 is biased in an opening direction by means of a relatively powerful circulating valve spring 33 pressing against the guiding extension 65. The strength of the circulating valve spring 33 is chosen with regard to the operating pressures and effective surfaces on the circulating valve element 32 that it provides a major portion of the opening force and is assisted by the pressure acting on the annular surface 63. A circulating valve pipe 34 leads to the circulating valve chamber 18 through an adjustable restrictor 35 from the circulating valve passage 36 which is connected directly to the source of pressurized fluid 10. From the otherwise sealed circulating valve chamber 18, a passage 20 leads on the one hand into a setting valve feed passage 19 which opens into the annular gap 21, and on the other hand through a circulating valve chamber outlet conduit 68 to a solenoid valve 29 for the circulating valve chamber 18. The solenoid valve 29 is, like valve 28, a two-position valve which is set to a normal first position allowing throughflow when the valve 29 is de-energized, and a second position preventing throughflow when the valve 29 is energized. The output from the valve 29 is ducted to the oil collection vessel 30 through an adjustable restrictor 69.

Solenoid valve 236 is a two-position valve, closed when de-energized and open when energized. In its closed position, as illustrated, the solenoid locks the pressure which originates in the pump chamber 13, passing through control bore 44 and restricting orifice 224 within setting valve chamber 233. This locked-in pressure acts effectively against the area of the setting sleeve abutment 227 producing a force biasing the setting valve sleeve upwards in the illustration, against the smaller opposing force produced by the pressure acting on the smaller area of the central bore diameter 222 of the setting sleeve 23. The stroke of the setting sleeve 23 is limited by the abutment face 229 of the setting sleeve cutaway 225 pressing against the abutment face 226 of the creep speed adjustment 228, this being threaded for axial adjustment in the setting valve housing 232. With solenoid 236 energized and in its open position, the pressure previously locked into the setting valve chamber 233 escapes through passages 234, 235, 27 and back to the fluid collection vessel 30. The reduced pressure results in a reduction of the force acting upon the setting sleeve abutment 227 which reduced force is now overcome by the greater opposing force acting upon the bore diameter 222 causing the setting sleeve 23 to move downwards in the illustration to where the setting sleeve abutment 227 strikes intermediate speed adjustment 230 threaded for axial adjustment in the setting valve housing 232.

The lift drive control system has been illustrated in a position wherein it is set for creeping speed travel of the lift, and wherein the individual valves are in hydraulic equilibrium. The magnetic valve 29 is energized and consequently maintains the duct 68 in a closed position.

OPERATION

The control system operates in the following manner:

The pump 10 supplies hydraulic oil into the pump chamber 13 via the conduit 12 when an elevator car, arranged on the elevator cylinder 17, is traveling upwardly at full speed. The solenoid valves 28 and 29 are energized, and consequently conduits 27 and 68 are in closed conditions. This prevents oil from flowing out of the pump chamber 13 via bypass or circulating valve passage 36, circulating valve conduits 34, adjusting restrictor 35 and circulating valve chamber 18, and then either via conduit 68, or via passage 19, setting valve 4 and passage 26. The pump pressure cannot diminish in circulating valve chamber 18, and hence the pump pressure prevailing in the circulating valve chamber 18 maintains the circulating valve element 32 in a closed position against the force of the spring 33, so that no oil can flow out through the circulating valve 3. Consequently, the check valve 2 is held open, the valve element 14 being displaced against the force of the spring 37 and opening the passage to the control block cylinder 15, so that the entire volume of oil delivered by pump 10 is fed to the cylinder 17 via check valve 2, cylinder 15, and cylinder conduit 16, and the elevator car is consequently driven upwardly at full speed corresponding to the pump delivery volume. This position of the lift drive control system has not been illustrated.

To switch the elevator car traveling at full speed to creeping speed travel prior to reaching a stopping point, the solenoid of the valve 28 is de-energized so that the valve 28 is switched to its illustrated throughflow position. The oil now flows out of the circulating valve chamber 18 to sump 30 via passages 20 and 19, annular gap 21, past the setting valve bore 22 on the control surface 51, through annular space 53, setting valve outflow 27, solenoid valve 28 and setting valve restrictor 31. The pressure in the circulating valve chamber 18 drops correspondingly so that the force exerted by the pressure on the circulating valve element 32 is no longer sufficient to overcome the force of the spring 33.

The circulating valve element 32 thus opens the bypass or circulating valve 3 so that part of the volume of oil delivered by the pump 10 flows to the oil collection vessel 30 through the circulating valve 3 and conduit 57. This reduces the volume of oil fed to the elevator cylinder 17 and the check valve 2 begins to close under the thrust of the spring 37. The amount of closing of the check valve 2 is proportional to the amount of opening of the circulating valve 3. During the closing of the check valve 2, the setting element 25 of the setting valve 4 is also displaced with the valve element 14, in such manner that the flow passage of valve 4 is reduced, the control edge 24 simultaneously partly covering the setting valve bore 22. This reduces the volume of oil issuing from the circulating valve chamber 18 in such manner that it corresponds to the volume of oil which is fed to the circulating valve chamber 18 through the adjusting restrictor 35. When this stage is reached, the system is in a state of hydraulic equilibrium during which a constant volume of oil flows to the elevator cylinder 17 through the check valve 2 and the residual volume of oil supplied by the source of pressurized fluid flows out to the oil collection vessel 30 through the circulating valve passage 36 and the circulating valve 3. A creeping speed of travel has now been reached. The creeping speed of travel depends on the adjustment of the setting valve bore 22 with respect to the control edge 24. The creeping speed of travel may be adjusted by axially displacing the sleeve 23 relative to the sealing bore. The area of operation during creeping speed travel is such that the control edge 24 is positioned approximately in the area of the setting valve bore 22. Before this position is reached, however, the control surface 51 becomes active in such manner as to prevent excessive opening of the circulating valve 3, thereby preventing an undesirable reduction of the speed of travel below the creeping speed, so that a change from full speed to creeping speed of travel can occur smoothly without jolting. The system is self-governing, adjusting itself for creeping speed travel, of the lift once the creeping speed has been preset, the valve element 14 of the check valve 1 and the setting element 25 of the setting valve 4 simultaneously being floatingly situated in all operating positions during creeping speed travel, and not bearing against fixed stops or the like.

During creeping speed travel the elevator cylinder 17 moves slowly upwardly toward the stopping point, and once this stopping point has been reached, the solenoid valve 29 is energized and switched to a position allowing throughflow by means of another signal triggered off by the elevator car (for example, so that the circulating valve chamber 18 is relieved of pressure and the circulating valve 3 opens fully under the thrust of the spring 33, whereupon the entire volume of oil delivered by the pump 10 flows out to the oil collection vessel 30 through the conduit 57). The check valve 2 simultaneously closes completely under the action of the spring 37 and prevents oil from flowing back from the elevator cylinder 17 and the elevator from unintentionally dropping.

To obtain an intermediate speed between, the up full speed the creeping speed of the elevator car, it is required that the pump 10 is running and solenoid 29 is energized in the fashion already described. In addition, solenoid 236 is energized and opens so that pressure in the setting valve chamber 233 is released through the passages 234, 235 and 27 to the oil collection vessel 30. Pressure in chamber 233 drops accordingly, allowing the setting valve 23 to be forced back against the intermediate speed adjustment 231 by pressure originating from the pump, through central bore 44 and acting in central bore compartment 38. With the setting valve sleeve 23 and consequently the setting valve bore 22 now in its lower position, the hydraulic balance between circulating valve 3 and check valve 2 will occur when the check valve is wider open, that is, under circumstances of increased flow through the check valve relative to the flow during creep speed previously described, resulting in a faster up creep speed of the elevator car.

A change in operation of the control system which is smooth and favorably affects riding qualities may be established by means of the different adjustable restrictors. The maximum opening of the circulating valve 3 is adjusted by means of the stop 61. Complementary control systems required for downward travel have not been illustrated. The structural embodiment of the control system and of its individual components may be modified in various ways, in which connection it is important, however, that the position of a creep speed setting sleeve can be switched by solenoid operation affecting the relation between the pressure forces acting in opposing direction on the setting sleeve causing the setting sleeve to adopt one of two, through two adjustments, predeterminable alternate positions thereby affecting the relationship between the size of opening of the circulating valve and that of the check valve through which the altered volume of fluid passes to the cylinder producing one of two selectable up creep speeds of travel of the elevator car while not affecting the selectability of the full up speed of travel.

I claim:

1. In a hydraulic elevator control system including a pressure fluid source (10) having a supply and return, means including a check valve (2) having an inlet and connecting the supply of said source with a cylinder (17) of the elevator, and means including a by-pass valve (3) connected across said source for by-passing said check valve, said by-pass valve normally being biased by biasing means (33) to the open condition and including a by-pass chamber (18) for receiving pressure fluid from said source via a fluid restrictor (35) for displacing said by-pass valve to the closed position against the force of said biasing means, and means including a solenoid valve (29) operable to connect said chamber with the return of said source and a setting valve having both a setting element which is connected to move with the check valve and a setting sleeve, wherein a flow passage from the by-pass chamber to the return is established between portions of both the setting element and the setting sleeve for controlling the operation of said check valve to provide an elevator full up speed, a slow creep up speed, and a stop position, as a function of the pressure of fluid in said by-pass chamber; wherein an hydraulic balance between the bypass valve and the check valve occurs as a function of the position of said portion of the setting sleeve;

means for providing an intermediate fast creep up speed between the full up speed and the slow creep up speed by shifting the setting sleeve during operation of the setting valve between two stationary limits wherein the hydraulic balance between the bypass valve and the check valve occurs in a state wherein said portion of the setting element is in a location closer to the inlet of the check valve for the slow creep up speed than for the intermediate fast creep up speed; the setting sleeve being shifted between the limits by controlling fluid pressure on the setting sleeve.

2. A hydraulic elevator system of claim 1 wherein the limits are adjustable.

3. A hydraulic elevator system of claim 1 wherein the limits are formed by adjustable threaded stops.

4. Apparatus as defined in claim 1 wherein the fluid pressure is controlled by selectively blocking return of the fluid to the source.

5. Apparatus as defined in claim 4 wherein a solenoid operated valve is used to selectively block return of the fluid to the source.

* * * * *